US010104469B2

(12) United States Patent
Jakowski

(10) Patent No.: US 10,104,469 B2
(45) Date of Patent: Oct. 16, 2018

(54) MULTIPLE APERTURE DEVICE FOR LOW-FREQUENCY LINE ARRAYS

(71) Applicant: Robert Bosch GmbH, Stuttgart (DE)

(72) Inventor: Steven J. Jakowski, Farmington, MN (US)

(73) Assignee: Robert Bosch GmbH, Stuttgart (DE)

( * ) Notice: Subject to any disclaimer, the term of this patent is extended or adjusted under 35 U.S.C. 154(b) by 1 day.

(21) Appl. No.: 15/307,256

(22) PCT Filed: May 1, 2015

(86) PCT No.: PCT/US2015/028742
§ 371 (c)(1),
(2) Date: Oct. 27, 2016

(87) PCT Pub. No.: WO2015/168520
PCT Pub. Date: Nov. 5, 2015

(65) Prior Publication Data

US 2017/0055071 A1 Feb. 23, 2017

Related U.S. Application Data

(60) Provisional application No. 61/987,303, filed on May 1, 2014.

(51) Int. Cl.
*H04R 1/20* (2006.01)
*H04R 1/34* (2006.01)
*H04R 1/40* (2006.01)

(52) U.S. Cl.
CPC ..... *H04R 1/345* (2013.01); *H04R 1/403* (2013.01); *H04R 2201/403* (2013.01)

(58) Field of Classification Search
CPC ... H04R 1/345; H04R 2201/403; H04R 1/403
(Continued)

(56) References Cited

U.S. PATENT DOCUMENTS 3,557,901 A * 1/1971 Young ..... H04R 1/345 181/176
3,584,160 A 6/1971 Janssen
(Continued)

FOREIGN PATENT DOCUMENTS

DE 3819217 A1 12/1989

OTHER PUBLICATIONS

International Search Report and Written Opinion for Application No. PCT/US2015/028742 dated Jul. 6, 2015 (14 pages).

*Primary Examiner* — Brian Ensey
(74) *Attorney, Agent, or Firm* — Michael Best & Friedrich LLP

(57) ABSTRACT

A Multiple Aperture Device (MAD) for directing sound from a low-frequency transducer. The MAD includes a front face, a rim, a bulb, and a plurality of walls. The front face has a plurality of apertures. The rim has a circumference which matches a circumference of a perimeter of the low-frequency transducer. The bulb covers a center of a diaphragm of the low-frequency transducer. The plurality of walls define cavities between the diaphragm of the low-frequency transducer and the plurality of apertures. The plurality of walls and the plurality of apertures define a spatial response in both horizontal and vertical planes for desired radiation patterns of sound produced by the low-frequency transducer.

16 Claims, 6 Drawing Sheets

(58) Field of Classification Search
USPC ..... 381/337, 339, 341, 343; 181/175, 176, 181/184, 185, 187, 188
See application file for complete search history.

(56) References Cited

U.S. PATENT DOCUMENTS

| | | | | |
|---|---|---|---|---|
| 3,722,616 | A | 3/1973 | Beavers | |
| 4,718,517 | A * | 1/1988 | Carlson | H04R 1/345 181/159 |
| 5,552,569 | A | 9/1996 | Sapkowski | |
| 6,661,898 | B2 | 12/2003 | Kuwabara | |
| 6,744,899 | B1 * | 6/2004 | Grunberg | H04R 1/30 381/340 |
| 6,794,798 | B2 | 9/2004 | Watanabe et al. | |
| 2004/0182642 | A1 | 9/2004 | Hutt et al. | |
| 2006/0233417 | A1 | 10/2006 | Steere et al. | |
| 2011/0243362 | A1 | 10/2011 | Chick et al. | |
| 2012/0321121 | A1 | 12/2012 | Taylor et al. | |

* cited by examiner

MULTIPLE APERTURE DEVICE FOR LOW-FREQUENCY LINE ARRAYS

RELATED APPLICATION

The present patent application claims the benefit of prior filed U.S. Provisional Patent Application No. 61/987,303, filed on May 1, 2014, the entire content of which is hereby incorporated by reference.

BACKGROUND

The present invention relates to a multiple aperture device for low-frequency line arrays. Specifically, the device converts the surface area of a single 12" woofer into the acoustic equivalent of multiple smaller transducers through multiple apertures for coherent summation when more than one element (woofer) is used in an array.

A line array is a loudspeaker system that is made up of a number of usually identical loudspeaker elements mounted in a line and fed in phase, to create a near-line source of sound. The distance between adjacent drivers is close enough that they constructively interfere with each other to send sound waves farther than traditional horn loudspeakers, and with a more evenly distributed sound output pattern. Each element in a line array must act as a "point source" over its operating bandwidth to achieve coherent summation of their wave fronts. In order to achieve coherent summation, the center-to-center spacing of these point sources cannot exceed one-half wavelength of the highest intended operating frequency. To satisfy the required low-frequency range and output it is often desirable to use a 12" diameter transducer (woofer). When arrayed in a line, the 12" diameter and subsequent 12" minimum center-to-center spacing means the woofers will only sum coherently to 600 Hz. This would require a very low crossover point for transitioning from the low-frequency transducer to the high-frequency device which is not possible for the devices being used.

Previous inventions used simple obstruction devices that provided only limited control of the vertical radiation pattern at the expense of uniformity of coverage in the horizontal plane.

SUMMARY

This invention divides the radiation of a single 12" transducer into the acoustic equivalent of multiple smaller devices that act as close-spaced point sources to provide improved summation, improved pattern control and substantially wider operating bandwidth.

In one embodiment, the invention provides a Multiple Aperture Device (MAD) for directing sound from a low-frequency transducer. The MAD includes a front face, a rim, a bulb, and a plurality of walls. The front face has a plurality of apertures. The rim has a circumference which matches a circumference of a perimeter of the low-frequency transducer. The bulb covers a center of a diaphragm of the low-frequency transducer. The plurality of walls define cavities between the diaphragm of the low-frequency transducer and the plurality of apertures. The plurality of walls and the plurality of apertures define a spatial response in both horizontal and vertical planes for desired radiation patterns of sound produced by the low-frequency transducer.

In another embodiment the invention provides a line array. The line array includes a plurality of speakers arranged in an array. Each of the plurality of speakers has a low-frequency transducer, and a Multiple Aperture Device (MAD). The MAD includes a front face, a rim, a bulb, and a plurality of walls. The front face has a plurality of apertures. The rim has a circumference which matches a circumference of a perimeter of the low-frequency transducer. The bulb covers a center of a diaphragm of the low-frequency transducer. The plurality of walls define cavities between the diaphragm of the low-frequency transducer and the plurality of apertures. The plurality of walls and the plurality of apertures define a spatial response in both horizontal and vertical planes for desired radiation patterns of sound produced by the low-frequency transducer.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following, description or illustrated in the following drawings. The invention is capable of other embodiments and of being practiced or of being carried out in various ways.

The invention converts the surface area of a single 12" woofer into the acoustic equivalent of multiple smaller transducers through multiple apertures for coherent summation when more than one element (woofer) is used in an array. The number and 3D geometry of apertures defines the spatial response in both horizontal and vertical planes for desired radiation patterns of sound produced by a frequency transducer. The size, shape, spacing and number of acoustic passages in the device accurately control the directivity of the radiated sound in both the vertical and horizontal planes to a higher frequency and with better uniformity than was previously possible.

Figure 1:
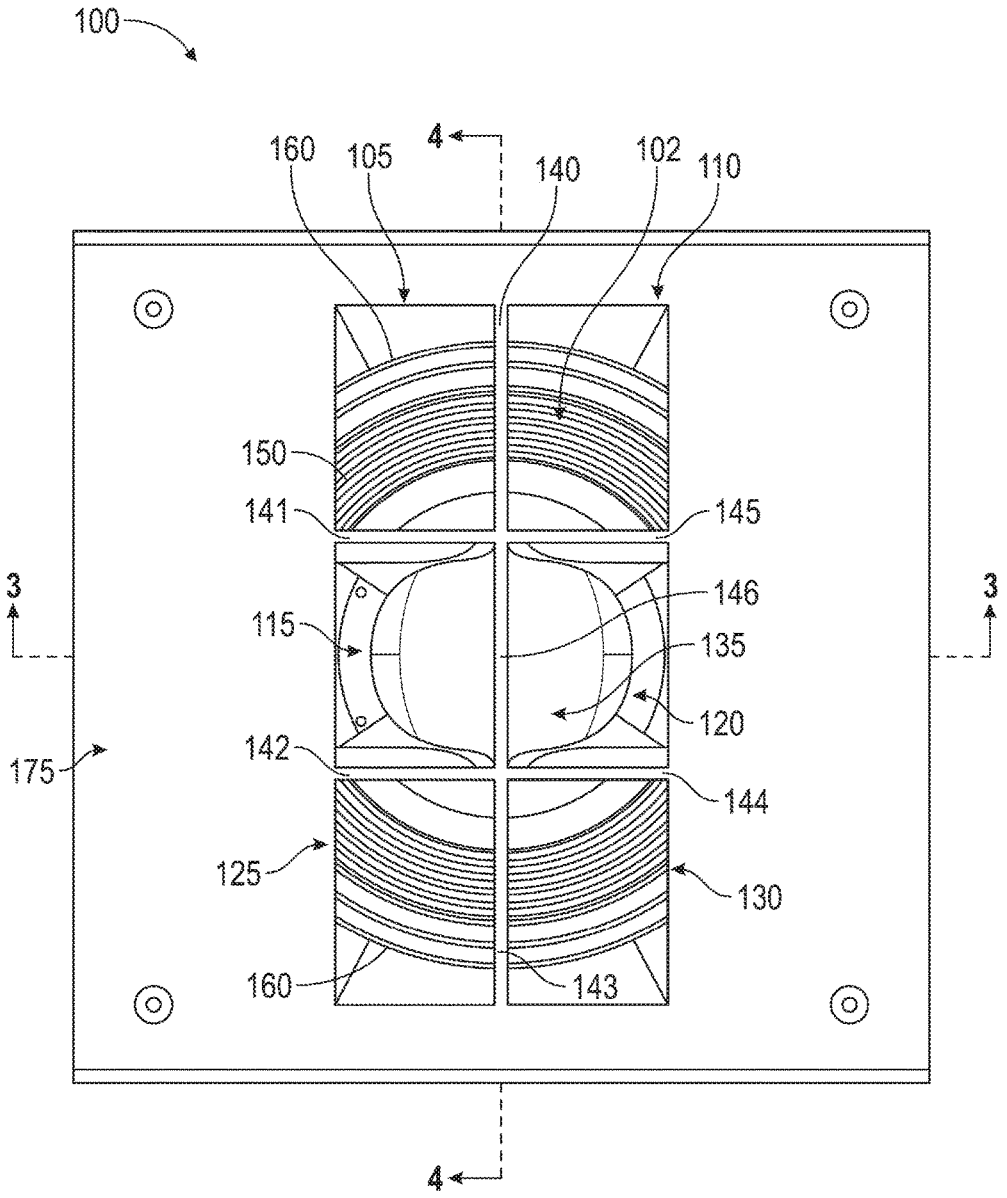
FIG. 1 is a front view of a Multiple Aperture Device in front of a frequency transducer.
Figure 2:
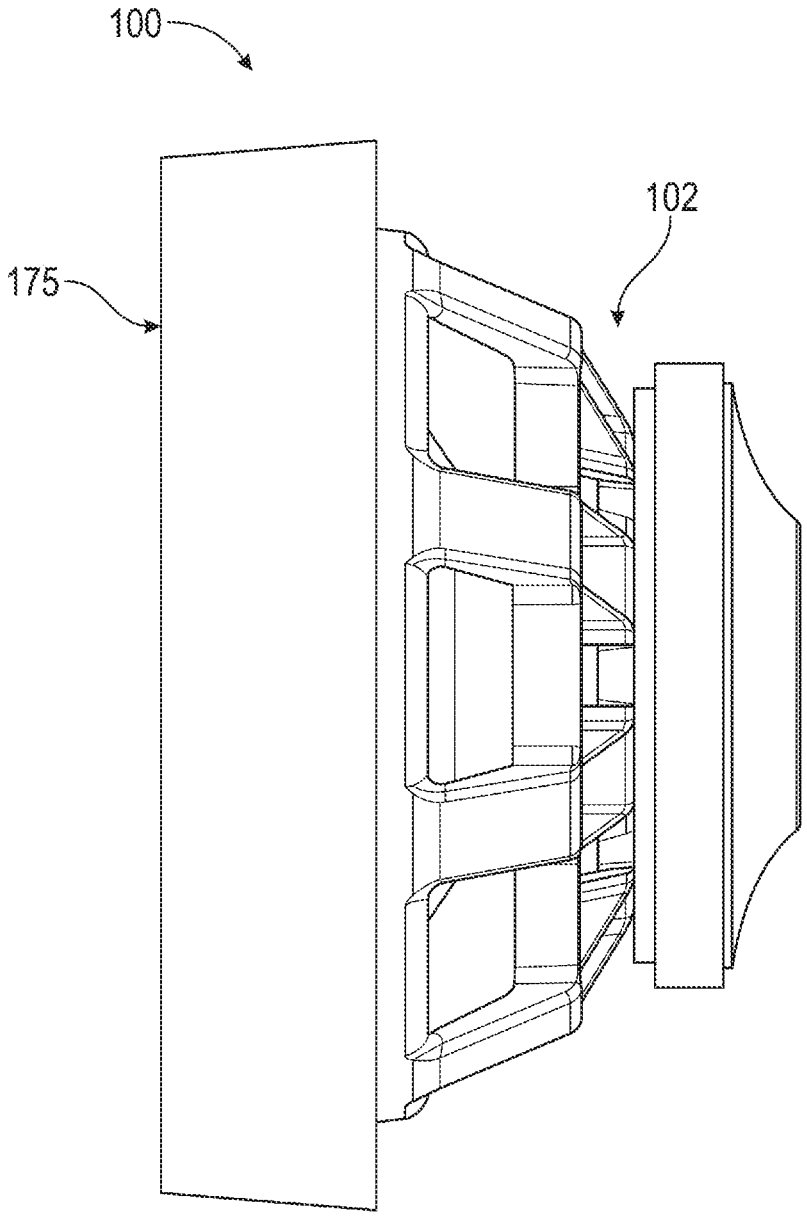
FIG. 2 is a side view of the Multiple Aperture Device in front of the frequency transducer.

FIG. 1 shows a front view of a Multiple Aperture Device (MAD) 100 in front of a low-frequency transducer 102 (e.g., a loud speaker). FIG. 2 is a side view of the MAD 100 in front of the low-frequency transducer 102. The MAD 100 includes a first aperture 105, a second aperture 110, third aperture 115, a fourth aperture 120, a fifth aperture 125, and a sixth aperture 130. The MAD 100 also includes a bulb 135. The apertures 105-130 are formed by walls 140, 141, 142, 143, 144, 145, and 146, and are rectangular in shape and all have the same dimensions.

The low-frequency transducer 102 has a diaphragm 150 which has a circular perimeter or edge 160. The bulb 135 covers a center of the diaphragm 150.

Figure 3:
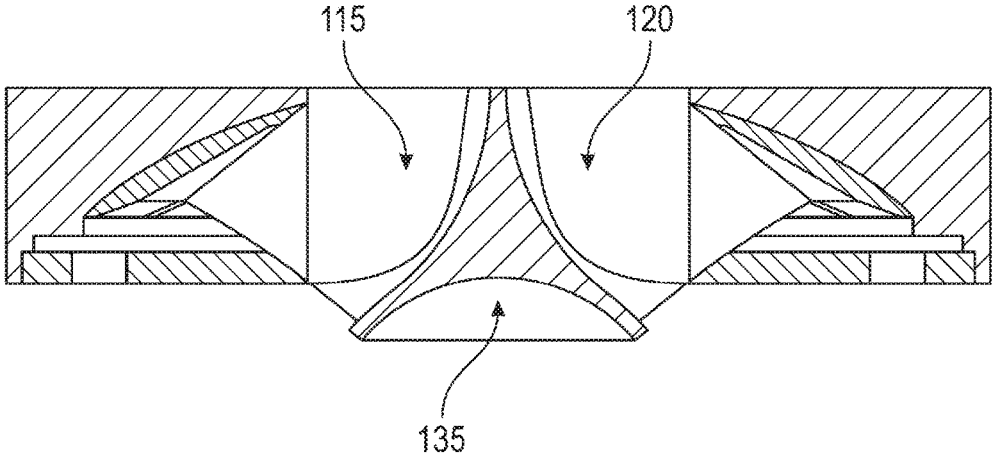
FIG. 3 is a cut-away view of the Multiple Aperture Device along the line 3-3.
Figure 4:
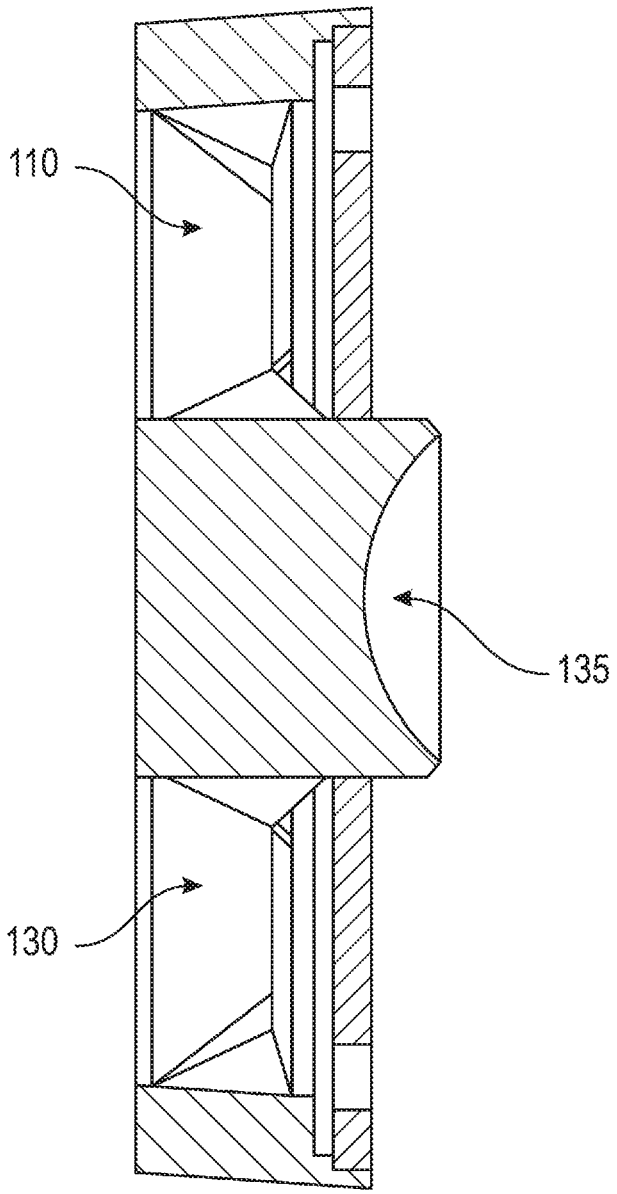
FIG. 4 is a cut-away view of the Multiple Aperture Device along the line 4-4.
Figure 5:
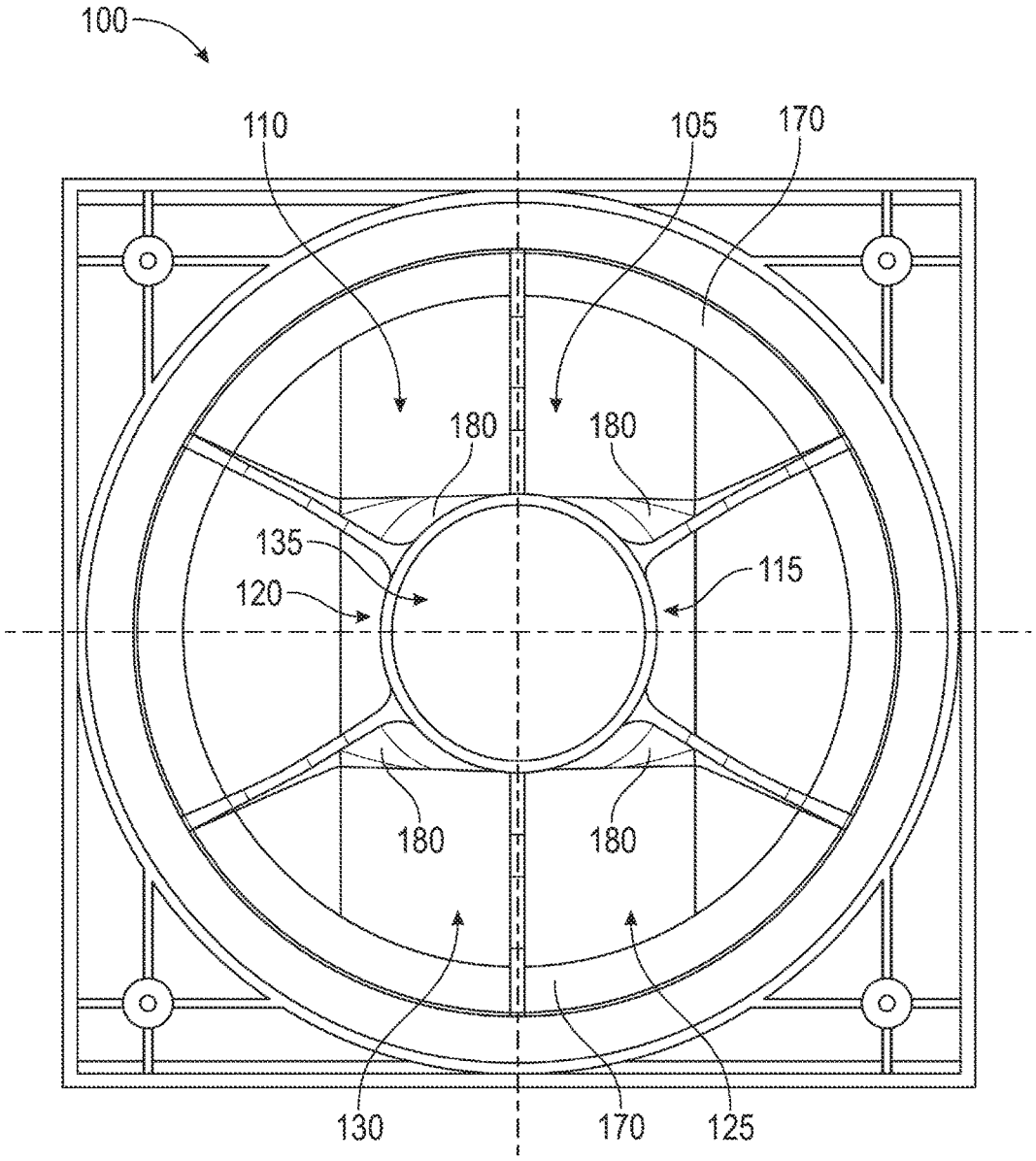
FIG. 5 is a back view of the Multiple Aperture Device.
Figure 6:
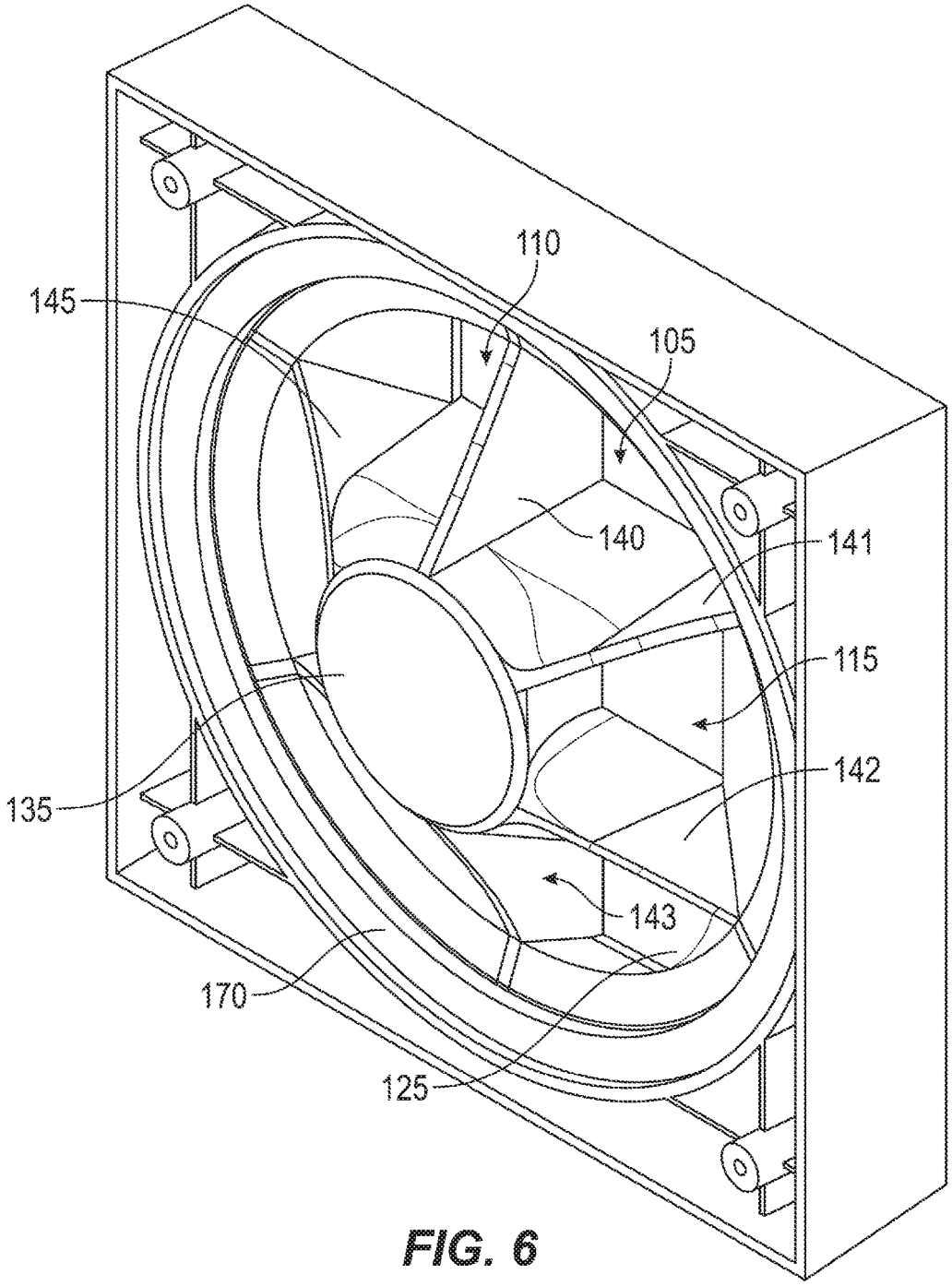
FIG. 6 is a plan view of the Multiple Aperture Device.

FIGS. 3 and 4 are cut-away views along the lines shown in FIG. 1. FIG. 5 is a back-view of the MAD 100. The MAD 100 has a circular rim 170 which has a circumference that matches a circumference of the perimeter 160 of the low-frequency transducer 102. The walls 140-146 extend from the bulb 135 to the rim 170 and are spaced equally (i.e., at equal angles) around the bulb 135 (i.e., at 60 degree intervals). The walls 140-146 each have an edge flush with a front face 175 of the MAD 100. The walls 140-146 extend from the front face 175 to a position near the diaphragm 150. A space is maintained between the diaphragm 150 and the walls 140-146 to allow movement of the diaphragm 150.

The walls 140-146 form cavities between the front face 175 of the MAD 100 and the apertures 105-130 and diaphragm 150. The cavities have similar, but not necessarily equal, lengths and volumes. The walls 141, 142, 144, and 145 have curved portions 180. The walls 140-146, apertures 105-130, and the area of the apertures 105-130 directly exposed to the diaphragm 150 all help define the spatial response in both horizontal and vertical planes for desired radiation patterns of sound produced by the frequency transducer 102. The size, shape, spacing and number of acoustic passages in the device accurately control the directivity of the radiated sound in both the vertical and horizontal planes to a higher frequency (i.e., significantly greater than 600 Hz for a 12" transducer 102, e.g., up to 2 kHz or higher, the embodiment shown here has been shown to sum up to 1800 Hz) and with better uniformity than was previously possible.

The above descriptions are for example purposes only. The invention contemplates other sizes of transducers and MADs along with other quantities of apertures. The MAD 100/loudspeaker 102 combination is intended to be used in a line array, combining a plurality of the MAD 100/loudspeaker 102 combinations in a line. However, the MAD 100/loudspeaker 102 combination can be used in other configurations as well.

Thus, the invention provides, among other things, a Multiple Aperture Device for defining the spatial response in both horizontal and vertical planes for desired radiation patterns of sound produced by a frequency transducer.

What is claimed is:

1. A Multiple Aperture Device (MAD) for directing sound from a low-frequency transducer, the MAD comprising:

a front face having a plurality of apertures;

a rim having a circumference which matches a circumference of a perimeter of the low-frequency transducer;

a circular bulb having a concave surface facing and covering a center of a diaphragm of the low-frequency transducer; and a plurality of walls defining cavities between the diaphragm of the low-frequency transducer and the plurality of apertures;

wherein the plurality of walls and the plurality of apertures define a spatial response in both horizontal and vertical planes for desired radiation patterns of sound produced by the low-frequency transducer.

2. The MAD of claim 1, wherein the plurality of apertures are rectangular in shape and are substantially equal in size.

3. The MAD of claim 2, wherein the low-frequency transducer is a twelve inch woofer.

4. The MAD of claim 3, wherein the plurality of walls extend from the bulb to the rim and are spaced equally around the bulb.

5. The MAD of claim 4, wherein the plurality of apertures consists of six aperture and the plurality of walls are spaced at about sixty degrees angles around the bulb.

6. The MAD of claim 1, wherein each of the cavities are about the same volume.

7. The MAD of claim 1, wherein the plurality of walls extend from the bulb to the rim and are spaced equally around the bulb.

8. The MAD of claim 1, wherein the plurality of apertures consists of six aperture and the plurality of walls are spaced at about sixty degrees angles around the bulb.

9. The MAD of claim 1, wherein each of the cavities are about the same volume.

10. The MAD of claim 1, wherein some of the plurality of walls are curved.

11. A line array comprising:

a plurality of speakers arranged in an array, each of the plurality of speakers having a low-frequency transducer, and a Multiple Aperture Device (MAD) including a front face having a plurality of apertures, a rim having a circumference which matches a circumference of a perimeter of the low-frequency transducer, a circular bulb having a concave surface facing and covering a center of a diaphragm of the low-frequency transducer; and a plurality of walls defining cavities between the diaphragm of the low-frequency transducer and the plurality of apertures, wherein the plurality of walls and the plurality of apertures define a spatial response in both horizontal and vertical planes for desired radiation patterns of sound produced by the low-frequency transducer.

12. The line array of claim 11, wherein the low-frequency transducers are twelve inch woofers.

13. The line array of claim 12, wherein the low-frequency transducers sum coherently to 1800 Hz.

14. The line array of claim 11, wherein the plurality of walls extend from the bulb to the rim and are spaced equally around the bulb.

15. The line array of claim 11, wherein each of the plurality of apertures consists of six aperture and the plurality of walls are spaced at about sixty degrees angles around the bulb.

16. The line array of claim 11, wherein each of the cavities are about the same volume.

* * * * *